US007318638B2

(12) United States Patent
Shimizu et al.

(10) Patent No.: US 7,318,638 B2
(45) Date of Patent: Jan. 15, 2008

(54) LIQUID EJECTING APPARATUS

(75) Inventors: Yoshiaki Shimizu, Nagano-Ken (JP); Nobuhito Takahashi, Nagano-Ken (JP); Masaru Takahashi, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 262 days.

(21) Appl. No.: 10/814,648

(22) Filed: Apr. 1, 2004

(65) Prior Publication Data

US 2005/0052490 A1 Mar. 10, 2005

(30) Foreign Application Priority Data

Apr. 2, 2003 (JP) ..... 2003-098938
Mar. 30, 2004 (JP) ..... 2004-099691

(51) Int. Cl.
*B41J 2/165* (2006.01)

(52) U.S. Cl. ..... 347/30

(58) Field of Classification Search ..... 347/22, 347/29, 30, 36; 417/477.1, 477.6, 477.7, 417/477.12

See application file for complete search history.

(56) References Cited

U.S. PATENT DOCUMENTS 5,486,854 A * 1/1996 Uchida ..... 347/30
6,291,815 B1 * 9/2001 Sugiyama et al. ..... 250/231.13
6,523,414 B1 * 2/2003 Malmstrom et al. ..... 73/705

FOREIGN PATENT DOCUMENTS

JP 7-253082 A 10/1995
JP 2002-130153 A 5/2002
JP 2003-239872 A 8/2003

* cited by examiner

*Primary Examiner*—Stephen Meier
*Assistant Examiner*—Geoffrey S. Mruk
(74) *Attorney, Agent, or Firm*—Sughrue Mion, PLLC

(57) ABSTRACT

The apparatus includes a tube pump for discharging a fluid in a capping means sealing a nozzle forming face of a liquid ejecting head, having a roller member rolling on an inner periphery of a curved part of a tube member by pressing and deforming the curved part and a leak point, a phase detection means for detecting a phase of a rotational motion of the roller member, and a control means for controlling the operation of the tube pump. The control means has a function for stopping the roller member at a predetermined position based on information on the phase of the rotational motion of the roller member detected by the phase detection means. The suction amount of the liquid suction operation by the tube pump is prevented from variation.

7 Claims, 15 Drawing Sheets

SECTION OF TUBE MEMBER PRESSED AND DEFORMED BY ROLLER MEMBER IS 180°

SECTION OF TUBE MEMBER PRESSED AND DEFORMED BY ROLLER MEMBER IS 170°

LIQUID EJECTING APPARATUS

BACKGROUND OF THE INVENTION

1. Field of the Invention

The present invention relates to a liquid ejecting apparatus having a liquid ejecting head for ejecting liquid drops from a nozzle opening.

2. Description of the Related Art

As a typical example of a conventional liquid ejecting apparatus, there is an ink jet recording apparatus having an ink jet recording head for recording images. As other liquid ejecting apparatuses, for example, an apparatus having a coloring material ejecting head used to manufacture a color filter for a liquid crystal display, an apparatus having an electrode material (conductive paste) ejecting head used to form an electrode for an organic EL display and a face emission display (FED), an apparatus having a biological organic substance ejecting head used to manufacture biological chips, and an apparatus having a sample ejecting head as a precise pipette may be cited.

The ink jet recording apparatus which is a typical example of the liquid ejecting apparatus makes comparatively little noise during printing and can form small dots in high density, so that it is used recently in many printings including color printing.

Such an ink jet recording apparatus generally has an ink jet recording head (liquid ejecting head) which is loaded on a carriage and moves back and forth in the width direction (head scanning direction) of a recording medium such as a recording paper and a medium feed means for moving the recording medium in the perpendicular direction (medium feed direction) to the head scanning direction.

In the ink jet recording apparatus, printing is carried out by ejecting ink drops (liquid drops) to a recording medium from a recording head in correspondence to print data. And, the recording head loaded on the carriage is enabled to eject ink of various colors such as black, yellow, cyan, and magenta, thus not only text printing by black ink but also full-color printing are enabled by changing the ejection rate of various colors of ink.

The ink jet recording apparatus, to charge ink in the ink flow path in the recording head at the start time of use or to prevent the nozzle opening from clogging due to volatilization of an ink solvent, has an ink suction function for forcibly suck in and discharging ink from the nozzle opening of the recording head. The forcible ink discharging process executed to eliminate clogging of the recording head or discharge residual bubbles in the recording head is called a cleaning operation. And, the cleaning operation is executed in a case of restart of printing after suspension of the recording apparatus for many hours or when a user recognizes print quality faults such as print blurs and operates the cleaning switch.

The cleaning operation seals the nozzle forming face of the recording head by the capping means, applies a negative pressure into the capping means, thereby discharges ink from the nozzle openings of the recording head, sucks in ink discharged in the capping means, and sends it to the waste ink tank. Thereafter, a sequence of wiping the nozzle forming face of the nozzle plate of the recording head is executed by the wiping means composed of an elastic plate such as rubber.

As a means for applying a negative pressure into the capping means, the so-called tube pump in which the structure is comparatively simple and can be miniaturized and the machinery sucking in and discharging ink is free of contamination is generally used. The tube pump, as shown in FIG. 15, has a flexible tube 50 in which a part thereof is curved in a circular ring shape and the outer periphery thereof is supported by a pump frame (not shown in the drawing) and a roller member 51 for rotating the inner periphery of the circular ring-shaped part of the flexible tube 50 using the power of the paper feed motor.

And, in the tube pump, the roller member 51 rotates by sequentially crushing the circular ring-shaped part of the flexible tube 50, thus pressure is generated in the flexible tube 50 to apply a negative pressure to the capping means. As mentioned above, the tube pump forcibly discharges ink from the recording head by a negative pressure and moreover, sucks ink discharged in the capping means and sends it to the waste ink tank.

Further, for the structure of the tube pump, in place of the structure that the tubes 50 curved in a circular ring shape are pulled out and crossed in the opposite directions as shown in FIG. 15, a constitution that both ends of the flexible tubes 50 curved in a circular ring shape are pulled out in the same direction and are bundled in the same plane as shown in FIG. 16 is proposed. This constitution has no tube crossing part unlike the tube pump shown in FIG. 15, so that the whole tube pump becomes thin and for example, even when two tubes 50 are installed in parallel to increase the pump capacity, the thickness thereof is suppressed to two times of the tube diameter.

In the conventional ink jet recording apparatus mentioned above, when starting the tube pump in the stop state, without controlling the start position of the roller member 51, the roller member 51 can start rotation from an optional position.

However, in the tube pump shown in FIG. 15 or 16, the suction amount structurally varies in accordance with the start position of the roller member 51. Therefore, particularly when the set value of the suction amount (rotation amount) is small, a problem arises that when the start position of the roller member 51 is changed, an actual suction amount varies.

Precisely speaking, the problem is that in the tube shown in FIG. 15 or 16, structurally, there is a position where the flexible tube 50 cannot be crushed by the roller member 51, that is, a leak point and when the roller member 51 is stopped at the leak point, a leak of liquid may be generated in the tube pump. Concretely, in the tube pump shown in FIG. 15, the part X where the flexible tubes 50 are crossed is a leak point and in the tube pump shown in FIG. 16, the part X where the flexible tubes 50 are bundled is a leak point.

And, at the start time of the suction operation, as shown in FIG. 17A, when the roller member 51 starts to move from a position far away from the leak point X, the distance from the movement start position to the leak point X is long, so that the suction amount increases accordingly. On the other hand, as shown in FIG. 17B, when the roller member 51 starts to move from a position close to the leak point X, at the point of time when a negative pressure is generated slightly after rotation start, the roller member 51 reaches the leak point X, and the magnitude of negative pressure is reduced due to a leak there, and the suction amount is reduced accordingly.

FIG. 17C is a graph showing the relationship between the rotation time [second] of the pump and the magnitude of negative pressure [−Pa], and a symbol A in the drawing indicates a negative pressure curve when the suction operation is started from the state shown in FIG. 17A, and a symbol B indicates a negative pressure curve when the suction operation is started from the state shown in FIG.

17B. Furthermore, in the graph shown in FIG. 17C, a negative pressure curve of a pump having no leak point is shown for comparison.

As shown in FIG. 17C, in both cases A and B, at the point of time when the roller member 51 reaches the leak point X, the magnitude of negative pressure is reduced, so that the suction amount is deduced in comparison to the pump having no leak point. And, the degree of reduction in the suction amount accompanying the leak at the leak point X is larger in the case B (FIG. 17B) than in the case A (FIG. 17A).

As mentioned above, in the tube pump having the leak point X, when the movement start position of the roller member 51 is changed, an actual suction amount is varied, and when the set value of the suction amount is small, variations of about ±30% are caused, and when the set value of the suction amount is medium, variations of about ±10% are caused. Further, when the set value of the suction amount is large, variations of about ±5% are caused, and this level of variations may be considered to be within the tolerance, so that in a case of suction of a large mount, the movement start position of the roller member 51 provides no trouble.

Further, if the roller member 51 is stopped at the position of the leak point X when the tube pump is stopped at the end time of the suction operation, ink already sucked by the tube pump flows backward on the capping means side in the negative pressure state. When a backflow of sucked ink is generated, the negative pressure in the capping means is not released normally, causing print faults such as color mixture and non-ejection.

Furthermore, among the conventional pump tubes, there is a type that a pair of roller members are pressed against a flexible tube curved in a U shape. In this kind of pump tube, in correspondence with the rotational motion of the roller members, a state that only one of the pair of roller members presses the tube and a state that both roller members press the tube are generated. And, in a state that both roller members are pressed against the tube, compared with a state that one roller member is pressed against the tube, the load for the motor which is a driving source for the tube pump is doubled.

And, when the pressing state by both roller members is generated immediately after rotation start of the roller members, before the rotational speed of the roller members reaches a preset value, a high load is applied to the motor of the pump. When the rotational speed of the roller members is low, the inertia force of the roller members is also small. As a result, when a high load is applied to the motor of the pump, the motor may step out.

The step-out of the motor may occur also at the position of the leak point X of the tube pump having a circular ring-shaped tube shown in FIGS. 17A and 17B.

SUMMARY OF THE INVENTION

The present invention was developed with the foregoing in view and is intended to provide a liquid ejecting apparatus capable of eliminating variations in the suction ratio in the liquid suction operation by a tube pump.

Further, another object of the present invention is to provide a liquid ejecting apparatus capable of preventing the tube pump from leaking at the end time of suction.

Furthermore, still another object of the present invention is to provide a liquid ejecting apparatus capable of preventing the driving source of the tube pump from defective operations.

To solve the above problems, the liquid ejecting apparatus according to the first aspect of the present invention comprises: a liquid ejecting head having nozzle openings for ejecting liquid drops; capping means for sealing a nozzle forming face of the liquid ejecting head to form a closed space; a tube pump for discharging a fluid in the capping means sealing the nozzle forming face, the tube pump having a flexible tube member having a curved part and a roller member rolling on an inner periphery of the curved part while pressing and deforming the tube member, wherein there exists a leak point where a pressing deformation amount of the curved part by the roller member becomes insufficient; phase detection means for detecting a phase of a rotational motion of the roller member along the inner periphery of the curved part; and control means for controlling an operation of the tube pump, the control means having a function for stopping the roller member at a predetermined position based on an information on the phase of the rotational motion of the roller member detected by the phase detection means.

Further, preferably, the predetermined position is a position other than the leak point.

Further, preferably, the predetermined position is a position of the curved part opposite to the leak point.

Further, preferably, the control means has a function for stopping the roller member at the predetermined position when stopping the tube pump at an end of a suction operation.

Further, preferably, the tube pump is structured so as to release the pressing state of the roller member to the tube member by inversely rotating the roller member, and the control means has a function for stopping the roller member at an end of a suction operation and then inversely rotating the roller member to stop at the predetermined position.

To solve the above problems, the liquid ejecting apparatus according to the second aspect of the present invention comprises: a liquid ejecting head having nozzle openings for ejecting liquid drops; capping means for sealing a nozzle forming face of the liquid ejecting head to form a closed space; a tube pump for discharging a fluid in the capping means sealing the nozzle forming face, the tube pump having a flexible tube member having a curved part and a roller member rolling on an inner periphery of the curved part while pressing and deforming the tube member; phase detection means for detecting a phase of a rotational motion of the roller member along the inner periphery of the curved part; and control means for controlling the rotational motion of the roller member of the tube pump based on an information on the phase of the rotational motion of the roller member detected by the phase detection means, the control means having a function for moving the roller member to a predetermined position by a low-speed rotation which cannot generate a negative pressure necessary for a liquid suction and then rotating the roller member by a high-speed rotation which can generate the negative pressure necessary for the liquid suction.

Further, preferably, the control means switches the low-speed rotation to the high-speed rotation without stopping the rotational motion of the roller member.

Further, preferably, the control means moves the roller member to the predetermined position by the low-speed rotation, then stops the rotational motion of the roller member once, and then starts the high-speed rotation.

In the present invention according to the aforementioned first and second aspects, preferably, the curved part of the tube member is in a circular ring shape.

Further, preferably, the phase detection means has a rotator rotating in synchronization with the rotational motion of the roller member and a detector for detecting a phase of a rotational motion of the rotator.

Further, preferably, the rotator has a notch and the detector detects the phase of the rotational motion of the rotator based on a change in a detection signal at the notch.

Further, preferably, the detector has a light emitter for radiating light toward the rotator and a light receiver for receiving light radiated from the light emitter.

As mentioned above, according to the present invention, on the basis of the information on the phase of the rotational motion of the roller member detected by the phase detection means, the control means can stop the roller member at the predetermined position, so that even in a tube pump having a leak point, the movement start position of the roller member at the start time of the tube pump can be always kept fixed, thus, for example, even when executing a suction operation having a low suction amount, an actual suction amount can be prevented from variations.

Moreover, when the aforementioned predetermined position is set at a position other than the leak point of the tube pump, and by the control means, the stop position of the roller member at the end time of the suction operation is set at the predetermined position other than the leak point, a leak in the tube pump at the end time of the suction operation can be prevented and a backflow of ink can be prevented.

Further, according to the present invention, on the basis of the information on the phase of the rotational motion of the roller member detected by the phase detection means, the control means can move the roller member to a predetermined position by a low-speed rotation whereby no negative pressure necessary for liquid suction can be generated and then can rotate the roller member by a high-speed rotation whereby a negative pressure necessary for liquid suction can be generated, so that even in a tube pump having a point where the load to the driving source for the pump is high, the relationship of the aforementioned predetermined position to the corresponding high-load point is optimized, thus defective operations of the driving source for the tube pump can be prevented.

BRIEF DESCRIPTION OF THE DRAWINGS

The foregoing and other objects, features, and advantages of the present invention will be understood from the following description in connection with the accompanying drawings.

FIG. 7A shows the state during forward rotation, and FIG. 7B shows the state during backward rotation.

FIG. 9A shows the state when the rotation angle of the pair of roller members is 90° or 270°, and FIG. 9B shows the state when the rotation angle is 0° or 180°, and FIG. 9C shows the load characteristics of the tube pump.

FIG. 13A shows a rough structure of the tube pump, and FIG. 13B shows the load characteristics of the tube pump.

FIG. 14A shows the state when the rotation angle of the roller member is 0°, and FIG. 14B shows the state when the rotation angle of the roller member is 180°, and FIG. 14C shows the load characteristics of the tube pump.

FIG. 17A shows the situation when the roller member starts movement from the position slightly advancing in the forward rotational direction from the leak point, and FIG. 17B shows the situation when the roller member starts movement from the position slightly before the leak point, and FIG. 17C is a graph showing the relationship between the rotation time of the pump and the negative pressure.

DESCRIPTION OF THE PREFERRED EMBODIMENTS

The ink jet recording apparatus as an embodiment of the liquid ejecting apparatus of the present invention will be explained below with reference to the accompanying drawings.

The ink jet recording apparatus of this embodiment has an ink jet recording head (an example of a liquid ejecting head) for ejecting ink drops (liquid drops) from each nozzle opening by changing the pressure of ink in each pressure chamber by each pressure generation element which is installed in correspondence with each pressure chamber interconnecting to each of a plurality of nozzle openings. As a pressure generation element, for example, a piezoelectric vibrator may be used.

Figure 1:
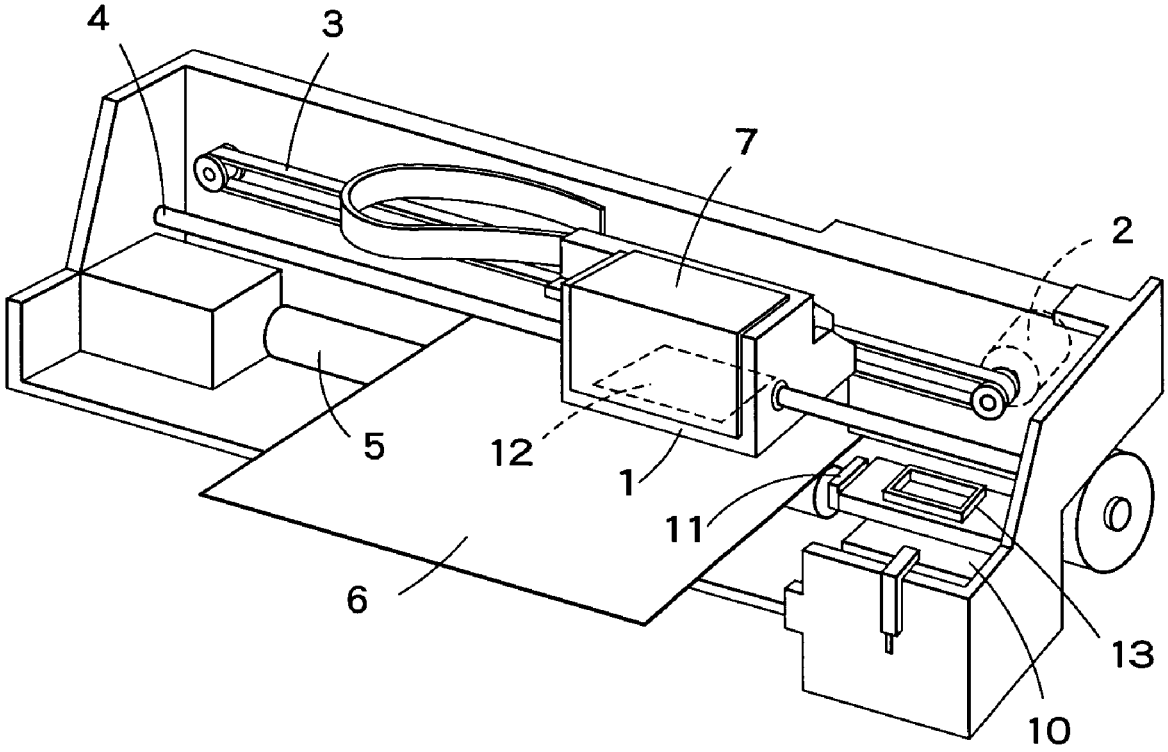
FIG. 1 is a perspective view showing the rough constitution of an ink jet recording apparatus as an embodiment of the liquid ejecting apparatus of the present invention.

FIG. 1 is a perspective view showing the rough constitution of the ink jet recording apparatus of this embodiment.

In FIG. 1, numeral 1 indicates a carriage and the carriage 1 is structured so as to be guided along a guide member 4 via a timing belt 3 driven by a carriage motor 2 and move back and forth in the axial direction of a platen 5. The platen 5 supports a recording paper 6 (an example of a recording medium) from the back thereof and defines the position of the recording paper 6 with respect to a recording head 12.

The recording head 12 is loaded on the side of carriage 1 facing the recording paper 6. Further, on the carriage 1, an ink cartridge 7 for feeding ink to the recording head 12 is removably mounted.

Figure 2:
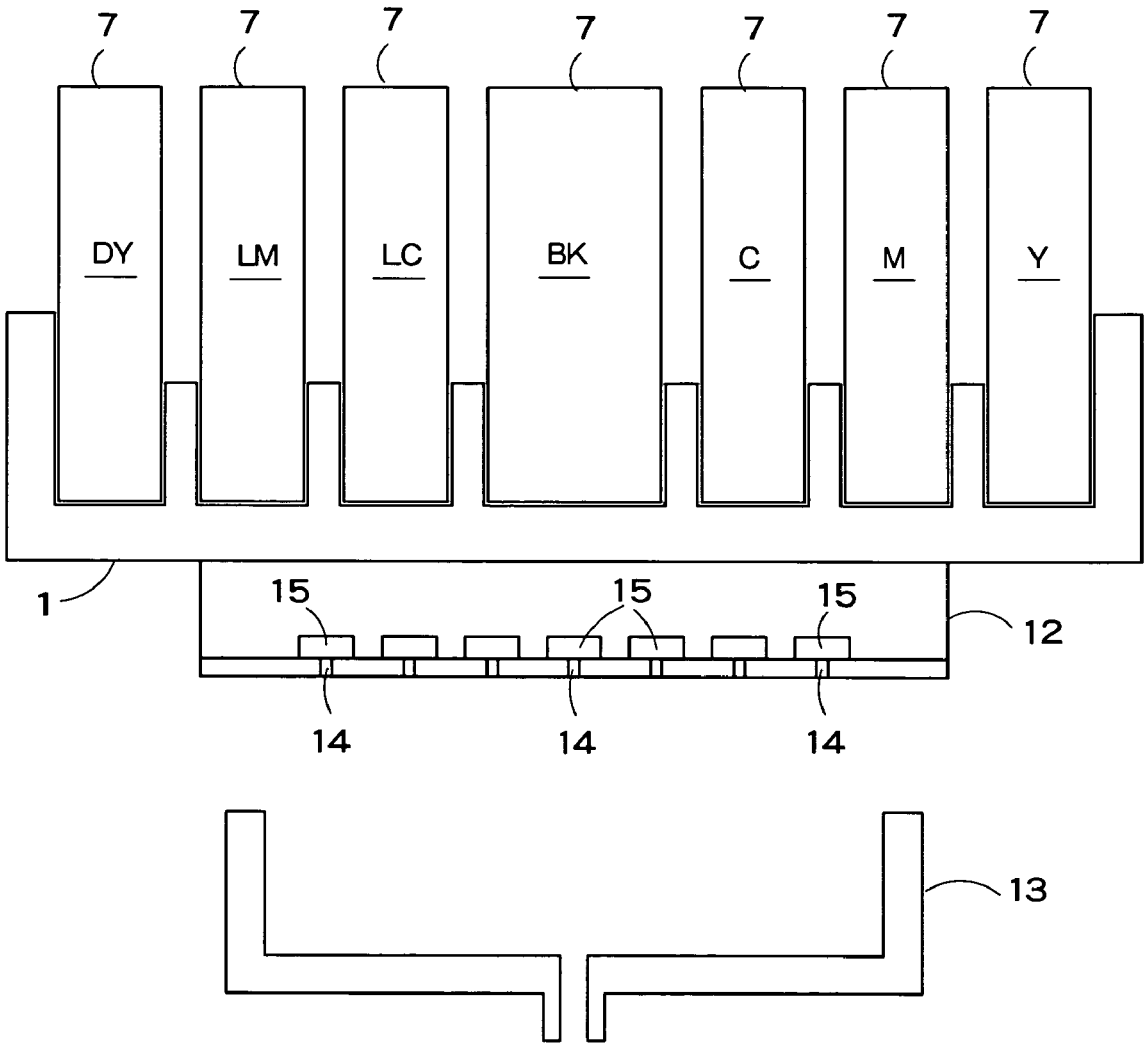
FIG. 2 is an enlarged drawing of the recording head, carriage, ink cartridge, and capping means of the ink jet recording apparatus shown in FIG. 1.

As shown in FIG. 2, in the recording head 12, a plurality of nozzle openings 14 and a plurality of pressure chambers 15 interconnecting to the nozzle openings 14 are formed. Ink drops can be ejected from the nozzle openings 14 by changing the pressure of ink in the pressure chambers 15.

As shown in FIG. 1, in the home position (the right side in FIG. 1) which is a non-printing area of the ink jet recording apparatus, a capping means 13 is arranged. The capping means 13 is structured so as to, when the recording head 12 loaded on the carriage 1 moves to the home position, move up from the position shown in FIG. 2, be pressed against the nozzle forming face of the recording head 12, and form a closed space between itself and the nozzle forming face. And, under the capping means 13, a tube pump 10 for applying a negative pressure to the closed space formed by the capping means 13 and sucking ink is arranged.

In the neighborhood of the capping means 13 on the printing area side, a wiping means 11 having an elastic plate such as rubber is arranged, for example, so as to horizontally move forward or backward with respect to the moving track of the recording head 12. The wiping means 11, when the carriage 1 moves on the capping means 13, is structured so as to wipe out the nozzle forming face of the recording head 12 when necessary.

The ink jet recording apparatus further has a paper feed mechanism for intermittently feeding the recording paper 6 to be printed (recorded) by the recording head 12 in the paper feed direction perpendicular to the head scanning direction.

Figure 3:
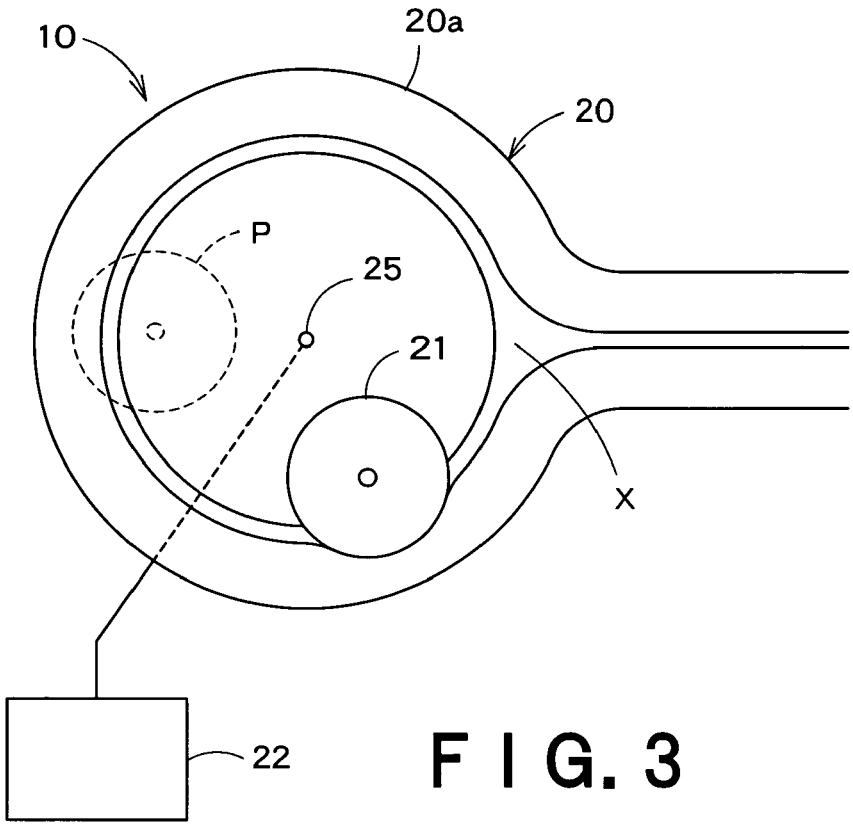
FIG. 3 is an enlarged drawing of the inner structure of the tube pump of the ink jet recording apparatus shown in FIG. 1.

FIG. 3 shows the inner structure of the tube pump 10 and as shown in FIG. 3, the tube pump 10 is of a type of pulling out both ends of the flexible tube curved in a circular ring shape in the same direction and bundling them in the same plane. The tube pump 10 has a tube member 20 including a circular ring-shaped part 20*a*, a roller member 21 rolling on the inner periphery of the circular ring-shaped part 20*a* of the tube member 20, a rotary plate 25 which supports rotatably the roller member 21 and rotates around the rotation axis 25*a*, and a motor (driving source) 22 for rotating the rotary plate 25, thereby rotating the roller member 21, and rolling the roller member 21 along the inner periphery of the circular ring-shaped part 20*a* of the tube member 20. The motor 22 can be replaced by the motor for the paper feed mechanism. The tube pump 10 includes the leak point X where the pressing deformation amount by the roller member 21 becomes insufficient.

Figure 15:
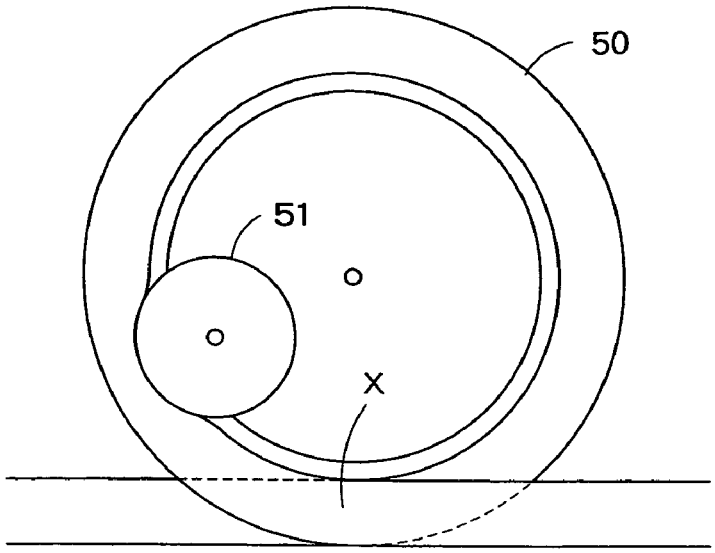
FIG. 15 PRIOR ART
FIG. 15 is a drawing showing an example of the tube pump of the conventional ink jet recording apparatus.
Figure 16:
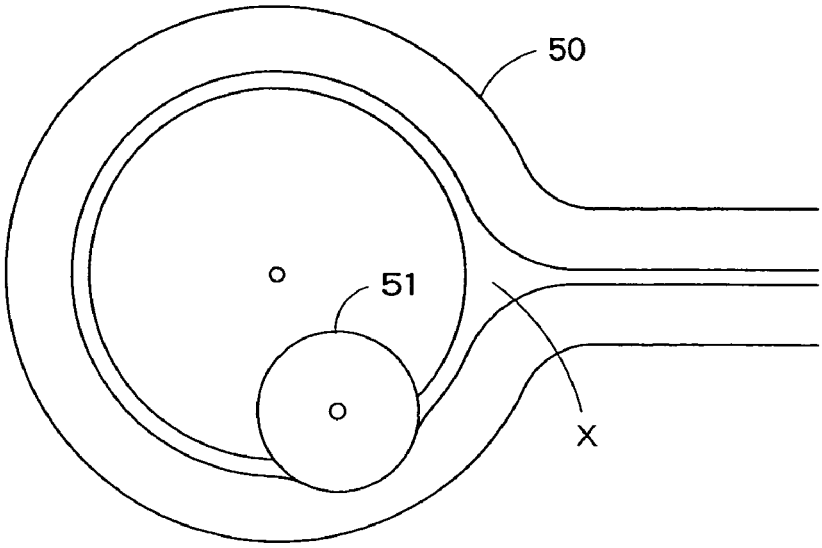
FIG. 16 PRIOR ART
FIG. 16 is a drawing showing another example of the tube pump of the conventional ink jet recording apparatus.
Figure 17A:
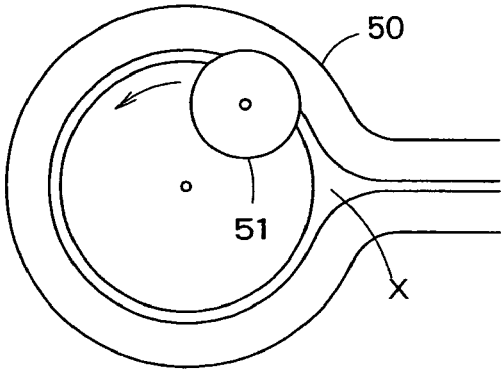
FIG. 17A PRIOR ART
FIGS. 17A, 17B, and 17C are drawings for explaining the characteristics of the tube pump of the conventional inkjet recording apparatus.
Figure 17B:
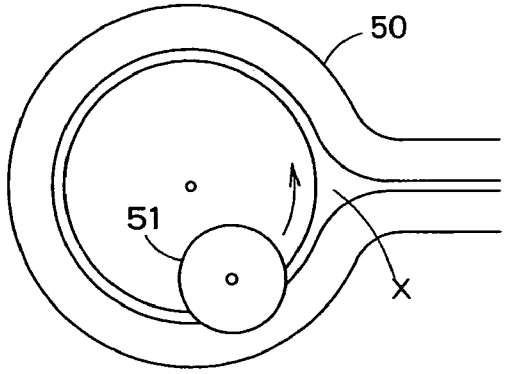
FIG. 17B PRIOR ART
Figure 17C:
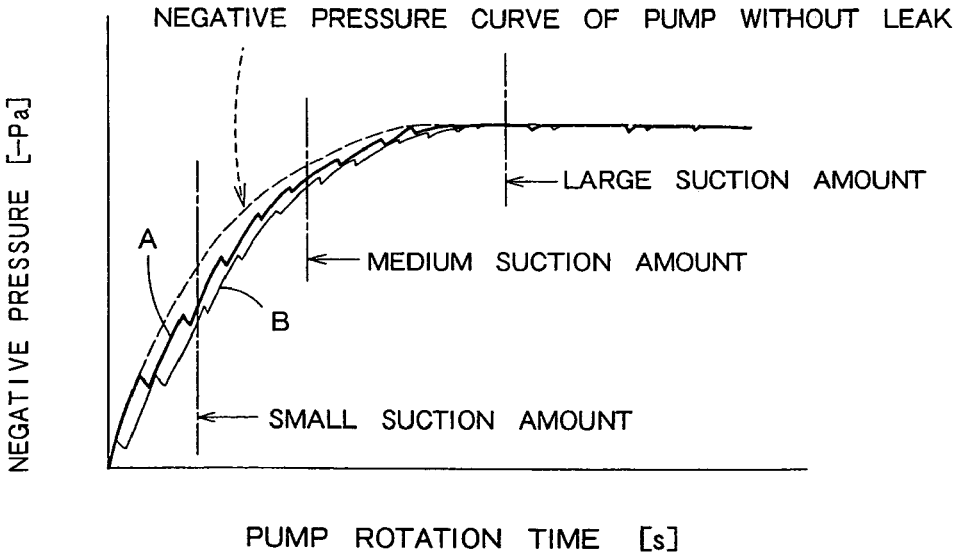
FIG. 17C PRIOR ART

Further, as a constitution of the tube pump, in place of the type of pulling out both ends of the flexible tube curved in a circular ring shape in the same direction and bundling them in the same plane as shown in FIG. 3, a constitution (refer to FIG. 15) of pulling out and crossing tubes curved in a circular ring shape in the opposite directions may be adopted.

Figure 4:
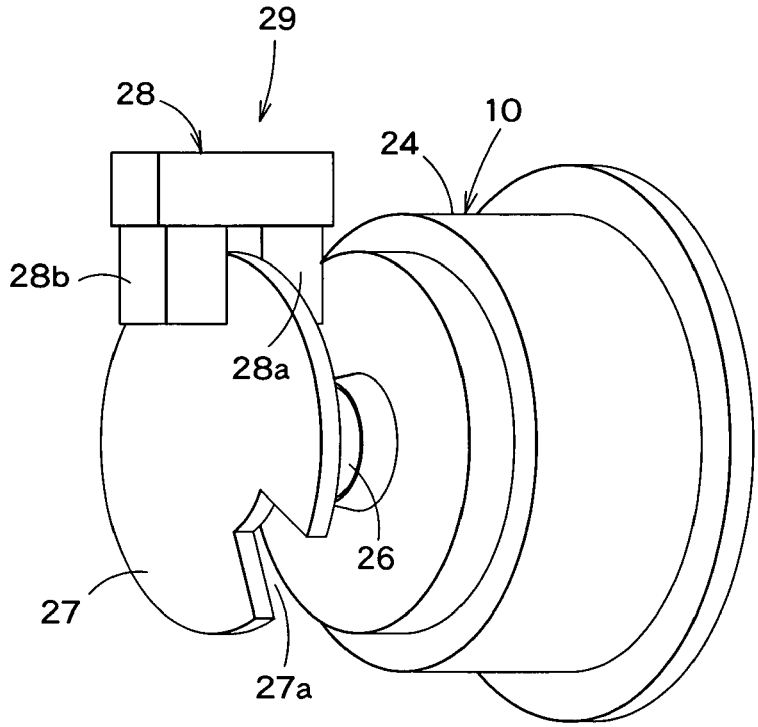
FIG. 4 is an external perspective view of the tube pump of the ink jet recording apparatus shown in FIG. 1.

FIG. 4 is a perspective view showing the outline of the tube pump 10 of this embodiment, and numeral 24 shown in FIG. 4 indicates a pump frame, and inside the pump frame 24, the circular ring-shaped part 20*a* of the tube member 20 shown in FIG. 3 is stored. Namely, on the inner face of the pump frame 24, a support face for defining the outer shape of the flexible tube member 20 to a circular ring shape is formed.

As shown in FIG. 4, from one side of the pump frame 24, a detection rotation axis 26 rotating integrally with the rotation axis 25*a* (FIG. 3) of the rotary plate 25 rotating in correspondence with the rotational motion of the roller member 21 is projected. At the end of the detection rotation axis 26, a rotary circular plate (a rotator) 27 is attached and in the rotary circular plate 27, a notch 27*a* is formed.

Further, in the neighborhood of the rotary circular plate 27, a photosensor 28 for detecting the phase of the rotational motion of the rotary circular plate 27 is arranged so that the rotary circular plate 27 is inserted between a light emitter 28*a* and a light receiver 28*b* thereof in a non-contact state. The photosensor 28, on the basis of changes in a detection signal at the notch 27*a* of the rotary circular plate 27, detects the phase of the rotational motion of the rotary circular plate 27. The detection rotation axis 26, the rotary circular plate 27, and the photosensor 28 constitute a phase detection means 29 for detecting the phase of the rotational motion of the roller member 21.

Figure 5:
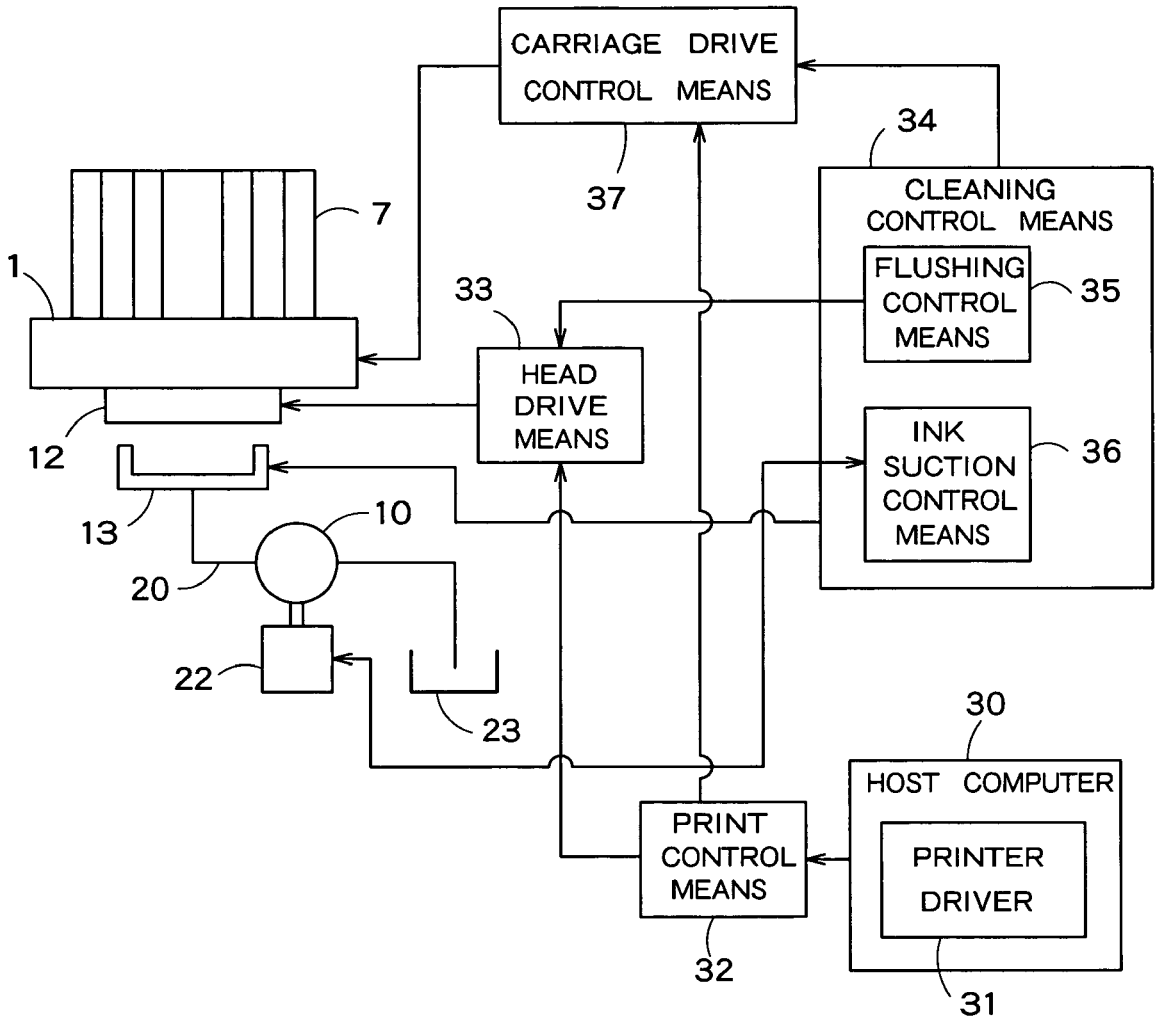
FIG. 5 is a block diagram showing the control circuit for controlling the cleaning operation (suction operation) of the recording head of the ink jet recording apparatus shown in FIG. 1.

FIG. 5 is a block diagram showing the control circuit for controlling the cleaning operation (suction operation) of the ink jet recording apparatus of this embodiment. As shown in FIG. 5, one end of the tube member 20 constituting the tube pump 10 is interconnected to the capping means 13 and the other end is interconnected to a waste liquid tank 23. By doing this, an ink waste liquid discharged into the inner space of the capping means 13 can be discarded into the waste liquid tank 23 via the tube pump 10.

Numeral 30 shown in FIG. 5 indicates a host computer and on the host computer 30, a printer driver 31 is loaded. And, on the utility of the printer driver 31, using the input device and display, the known paper size and print mode are selected and data such as font and a print instruction are input.

And, from the printer driver 31, print data is sent to a print control means 32, and the print control means 32, on the basis of the received print data, generates bit map data, and a head drive means 33, on the basis of the bit map data, generates a drive signal, thus ink is ejected from the recording head 12.

The head drive means 33 is structured to output a drive signal for flashing to the recording head 12, upon receipt of a flashing instruction signal from a flashing control means 35 constituting a part of a cleaning control means 34, in addition to the drive signal on the basis of the print data.

The cleaning control means 34 further has an ink suction control means 36 which controls driving the tube pump 10, when executing ink suction as a cleaning operation. Further, the cleaning control means 34 switches the sealing state or non-sealing state of the nozzle forming face of the recording head 12 by the capping means 13.

Further, a carriage drive control means 37, on the basis of drive signals from the print control means 32 and the cleaning control means 34, moves the carriage 1 to a predetermined position.

The operations of control performed by the ink suction control means 36 will be explained below.

The ink suction control means 36 has a function for stopping the roller member 21 at a predetermined standby position on the basis of the information on the phase of the rotational motion of the roller member 21 detected by the phase detection means 29. Here, the predetermined standby position is a position other than the leak point X shown in FIG. 3 and is preferably the position P (the position indicated by a dashed line in FIG. 3) opposite to the leak point X of the circular ring-shaped part 20*a* of the tube member 20.

And, the ink suction control means 36, when stopping the tube pump 10 at the end time of the suction operation, stops the roller member 21 at the predetermined standby position P on the basis of a signal from the phase detection means 29. Further, the predetermined standby position P opposite to the leak point X is a position which can be most easily crushed among the whole circular ring-shaped part 20*a* of the tube member 20 and when the roller member 21 is stopped at this position, the tube pump 10 can be surely prevented from leaking.

Figure 6:
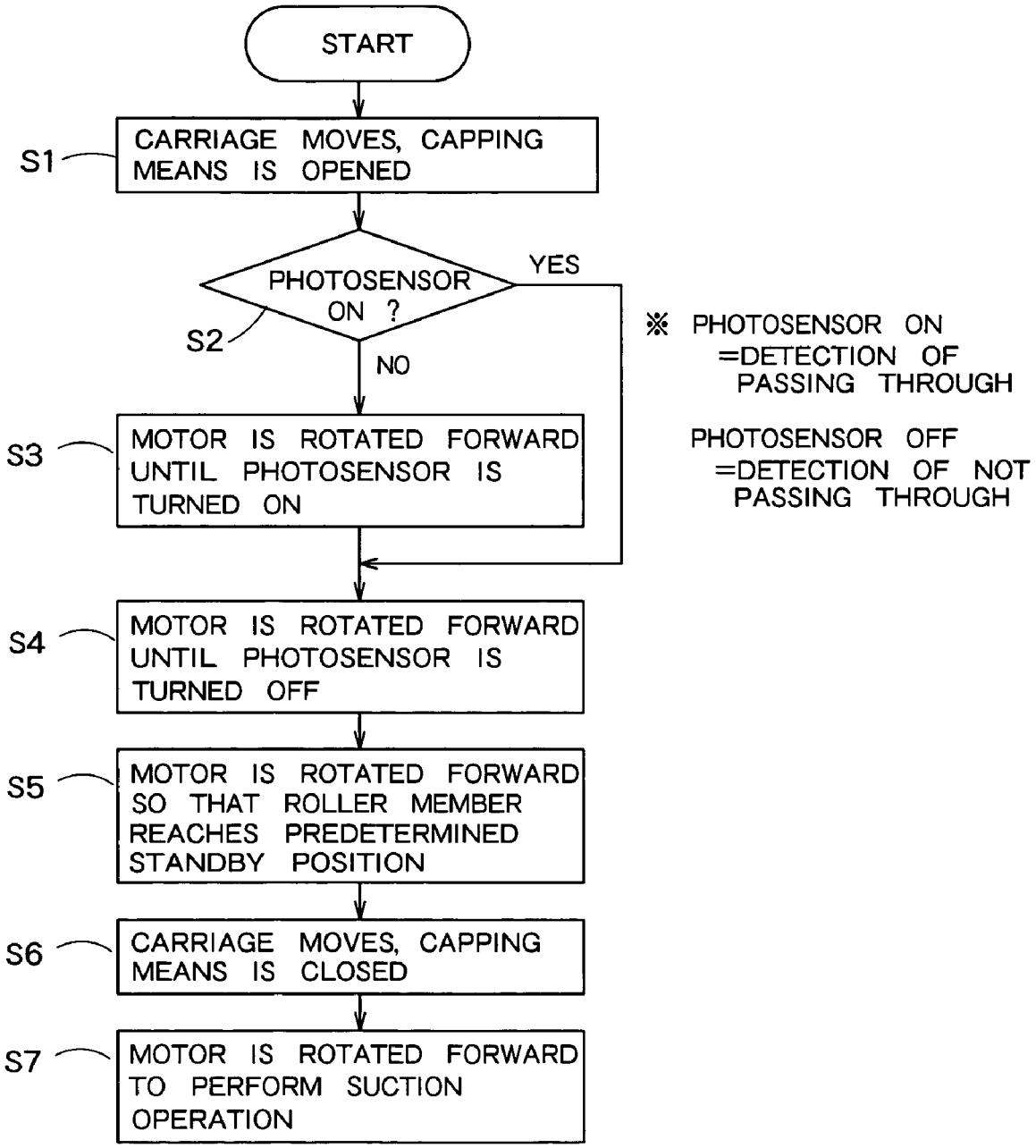
FIG. 6 is a drawing showing an example of the control sequence of the ink suction control means of the ink jet recording apparatus shown in FIG. 1.

FIG. 6 shows an example of the control sequence of the ink suction control means 36. When the preceding suction operation ends, and the carriage 1 moves and the capping means 13 is opened (Step 1), the ink suction control means 36 decides whether a detection signal of the photosensor 28 is on or off (Step 2). In this case, the detection signal of the photosensor 28 is turned on when the notch 27*a* of the rotary circular plate 27 reaches the position of the photosensor 28 and light radiated from the light emitter 28*a* passes through the notch 27*a* and reaches the light receiver 28*b*. On the other hand, the detection signal of the photosensor 28 is turned off when the part other than the notch 27*a* of the rotary circular plate 27 reaches the position of the photosensor 28 and light radiated from the light emitter 28*a* is interrupted by the rotary circular plate 27 and does not reach the light receiver 28*b*.

And, when it is decided at Step 2 that the photosensor 28 is off, the ink suction control means 36 rotates the motor 22 forward and rotates the roller member 21 until the photosensor 28 is turned on (Step 3). On the other hand, when it is decided at Step 2 that the photosensor 28 is on, the ink suction control means 36 skips Step 3 and goes to Step 4.

At Step 4, the ink suction control means 36 rotates the motor 22 forward and rotates the roller member 21 until the photosensor 28 is changed from on to off. And, at the point of time when the photosensor 28 is changed from on to off, the ink suction control means 36 rotates the motor 22 forward by a predetermined rotation amount, thereby rotates the roller member 21 by a predetermined rotation amount (Step 5). At Step 5, the roller member 21 is arranged at the predetermined standby position P shown in Step 3.

In the state that the roller member 21 is arranged at the predetermined standby position P like this, the carriage 1 is moved and the nozzle forming face of the recording head 12 is sealed by the capping means (Step 6). And, in this state, the ink suction control means 36 rotates the motor 22 forward, rotates the roller member 21, exhausts the inside of the capping means 13, and sucks ink from the nozzle opening of the recording head 12 (Step 7).

When starting the ink suction operation at Step 7, the roller member 21 always starts to move from the predetermined standby position P, so that for example, even when a suction operation whose suction amount is low is to be performed, an actual suction amount will not be varied.

As mentioned above, according to this embodiment, the ink suction control means 36 stops the roller member 21 at the predetermined standby position P at least before execution of the next suction operation, on the basis of the information on the phase of the rotational motion of the roller member 21 detected by the phase detection means 29, so that the start position of the roller member 21 at the start time of the tube pump 10 is always fixed. Therefore, for example, even when a suction operation whose suction amount is low is to be performed, an actual suction amount can be prevented from variation.

Moreover, in this embodiment, the predetermined standby position P mentioned above is set at the position other than the leak point X of the tube pump 10 and the stop position of the roller member 21 at the end time of the suction operation is set at the predetermined standby position P by the ink suction control means 36, so that a leak in the tube pump 10 at the end time of the suction operation can be prevented and a backflow of ink can be prevented.

Further, after the suction operation is finished and the tube pump 10 is stopped, the capping means 13 is opened after the negative pressure in the capping means 13 and the negative pressure in the recording head 12 enter the balanced state. In this situation, even during transfer of the intra-cap negative pressure and intra-head negative pressure to the balanced state, ink flows continuously. Therefore, as mentioned above, at the stop time of the pump after the suction operation, the tube pump 10 is prevented from leaking, thus the ink suction amount can be prevented from reduction.

Figure 7B:
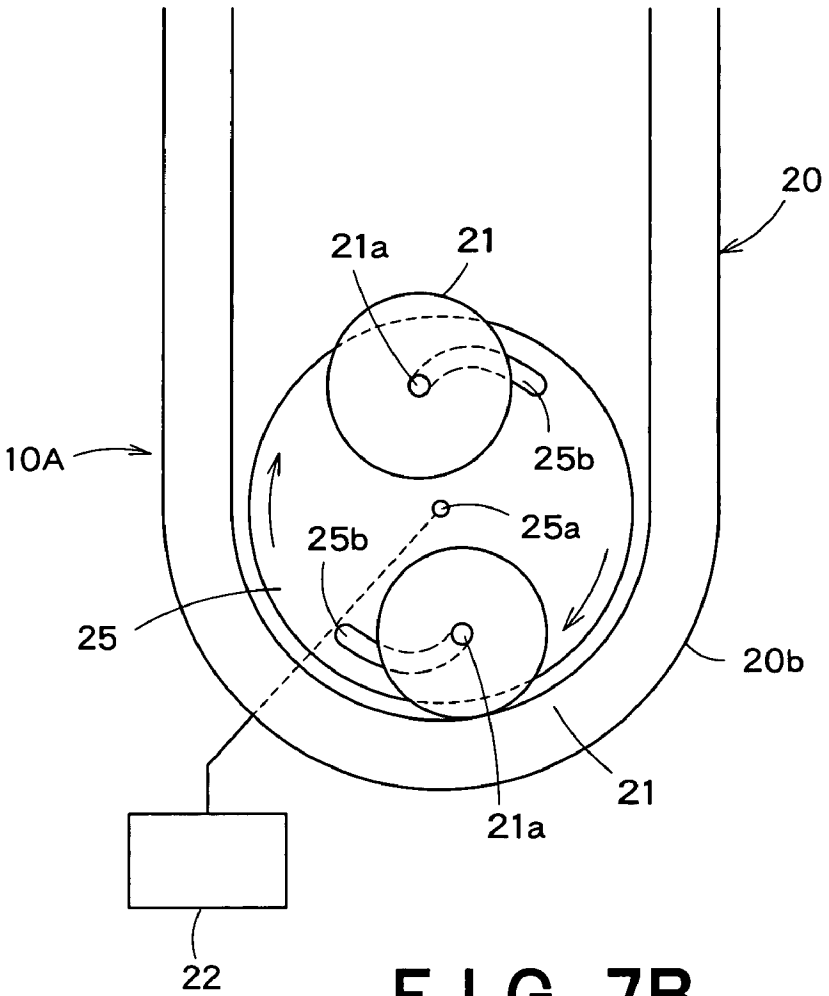
FIGS. 7A and 7B are enlarged drawings of the inner structure of another tube pump of the ink jet recording apparatus to which the present invention is applied.
Figure 7A:
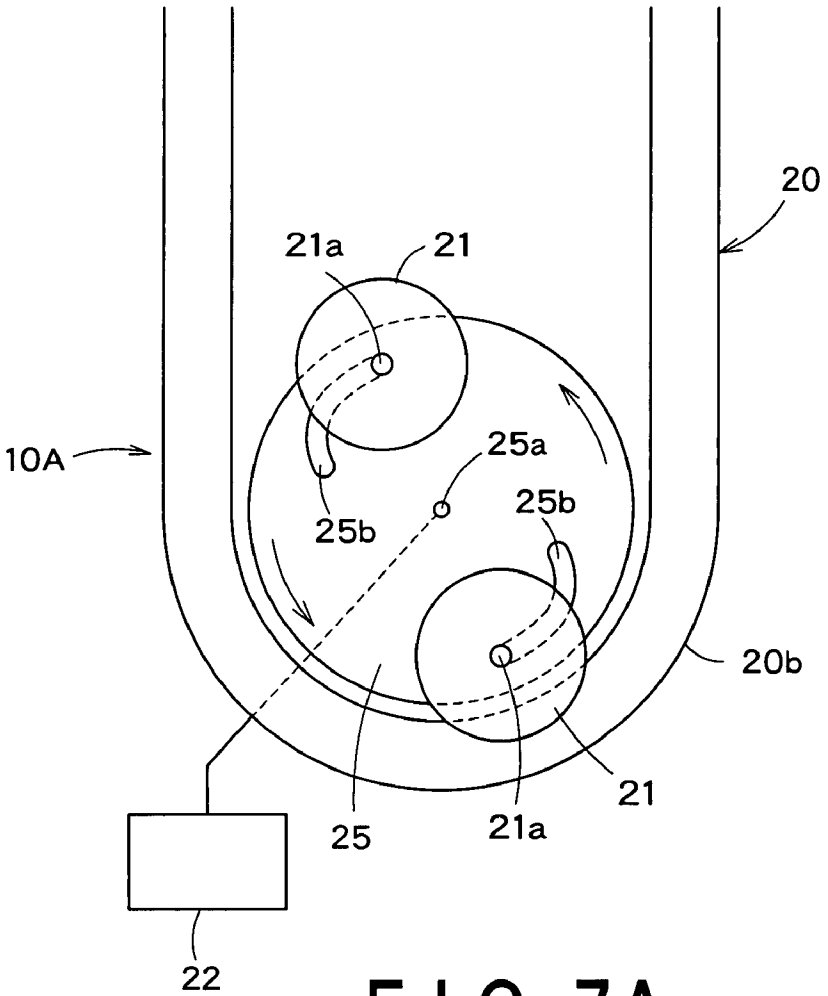

Further, in the aforementioned embodiment, as shown in FIG. 3, an example of the tube pump 10 having a single roller member 21 is explained. However, the tube pump of the liquid ejecting apparatus to which the present invention is applied is not limited to a type having a single roller member. For example, as shown in FIGS. 7A and 7B, the present invention can be applied to the tube pump 10A of a type of pressing a pair of roller members 21 against the U-shaped part 20*b* of the tube member 20. In this kind of tube pump 10A, the leak point can be eliminated by setting the section for pressing and deforming the tube member 20 in the U shape by the roller member 21 to 180°.

Further, in the tube pump 10A shown in FIGS. 7A and 7B, the rotation axis 21*a* of the roller member 21 is inserted into a guide hole 25*b* which is formed and bent in the rotary plate 25, and the rotational direction of the rotary plate 25 is switched, thus the rotation axis 21*a* of the roller member 21 moves between the ends of the guide groove 25*b*. FIG. 7A shows the state that the rotary plate 25 is rotated forward during the suction operation and FIG. 7B shows the state that the rotary plate 25 is rotated backward.

As shown in FIG. 7B, the end of the guide groove 25*b*, where the rotation axis 21*a* of the roller member 21 is positioned at the time of backward rotation of the rotary plate 25, is positioned inward in the radial direction of the rotary plate 25 in comparison to the other end of the guide groove 25*b*. Therefore, in this type of tube pump 10A, when the rotary plate 25 is rotated backward, the pressure of the roller member 21 against the tube member 20 can be released.

Figure 8:
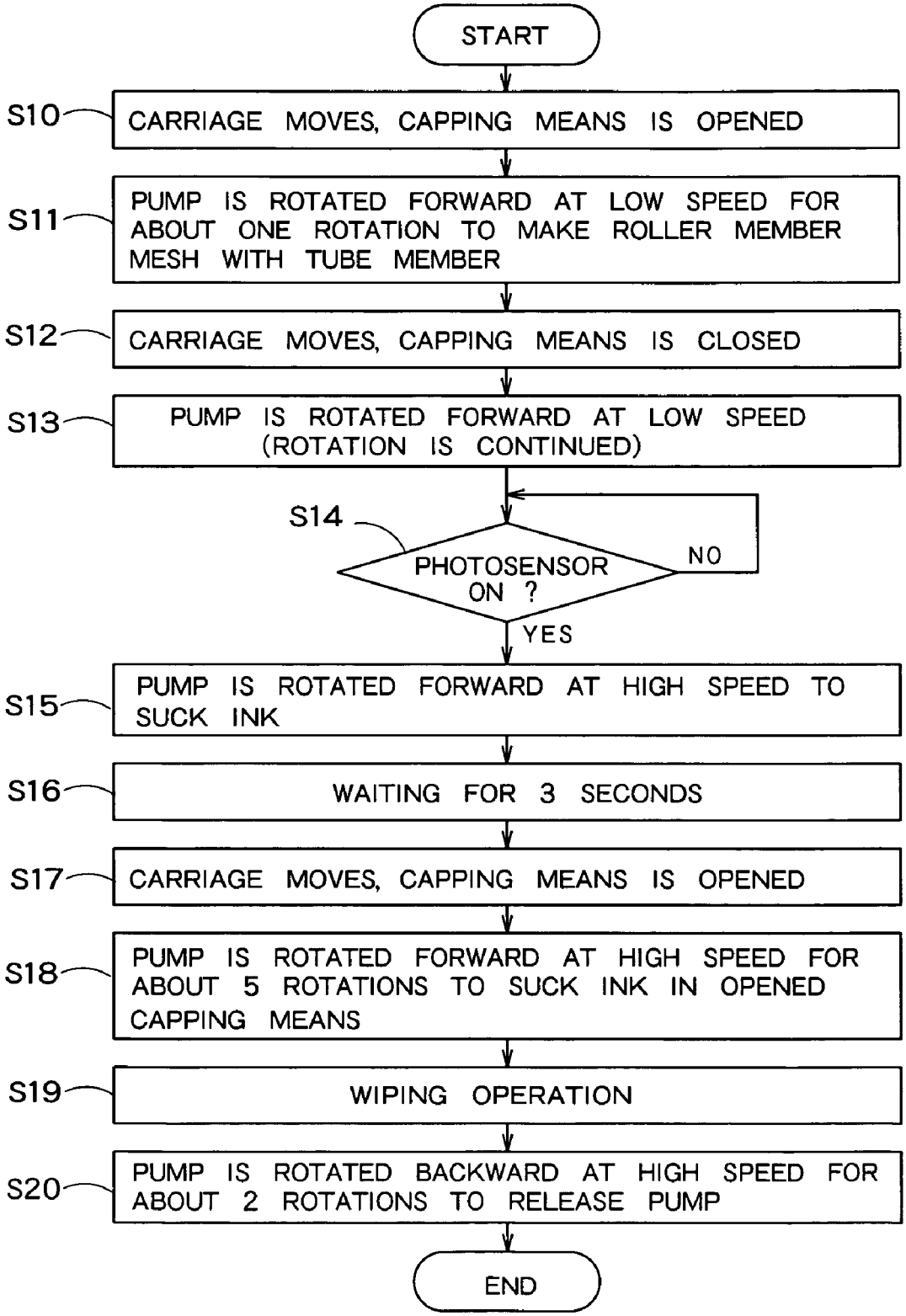
FIG. 8 is a flow chart showing another suction operation of the ink jet recording apparatus to which the present invention is applied.

FIG. 8 shows another control sequence of the suction operation executed by the cleaning control means 34 and here, the tube pump 10A shown in FIGS. 7A and 7B is used.

Firstly, the carriage 1 is moved and the capping means 13 is put into the open state (Step 10). In this state, the roller member 21 of the tube pump 10 makes about one rotation in the forward direction at low speed and the roller member 21 and the tube member 21 are meshed (Step 11). Next, the carriage 1 is moved and the nozzle forming face of the recording head 12 is closed up tightly by the capping means 13 (Step 12).

And, the capping means 13 is put into the closed state and the low-speed rotation of the roller member 21 is continued (Step 13). At this time, the rotational speed of the roller member 21 is low on a level of generating no negative pressure high enough for ink suction. The roller member 21 is rotated at low speed and it is decided whether the detection signal of the photosensor 28 is turned on or not (Step 14).

When the detection signal of the photosensor 28 is turned on, the roller member 21 in the low-speed rotation state, without stopping the rotational motion thereof, is switched to high-speed rotation for generating a negative pressure high enough for ink suction (Step 15). In this case, the detection signal of the photosensor 28 is switched from on to off within one rotation of the rotational motion of the roller member 21, so that ink suction at the time of low-speed rotation of the roller member 21 is prevented more surely.

And, at the ink suction step (Step 15), the roller member 21 is rotated by a predetermined number of times according to the magnitude of a necessary suction amount.

When the ink suction step is finished, after waiting for about 3 seconds until the negative pressure is released (Step 16), the carriage 1 is moved and the capping means 13 is put into the open state (Step 17). In this state, the roller member 21 makes about five forward rotations at high speed and ink in the capping means 13 is sucked and discharged (Step 18).

Next, by the wiping means 11, the nozzle forming face of the recording head 12 is wiped out (Step 19).

Finally, the roller member 21 makes about 2 backward rotations at high speed and the pressure state of the roller member 21 to the tube member 20 is released (Step 20).

According to the aforementioned suction operation sequence shown in FIG. 8, from the positioning operation of the roller member 21 by low-speed rotation, the suction operation is continuously performed by high-speed rotation, so that the necessary time of the suction operation sequence can be shortened.

Further, the aforementioned suction operation sequence shown in FIG. 8 is effective also in prevention of step-out due to load variations of the motor 22 of the tube pump 10A during the suction operation sequence, as explained below by referring to FIGS. 9A, 9B, and 9C.

Figure 9A:
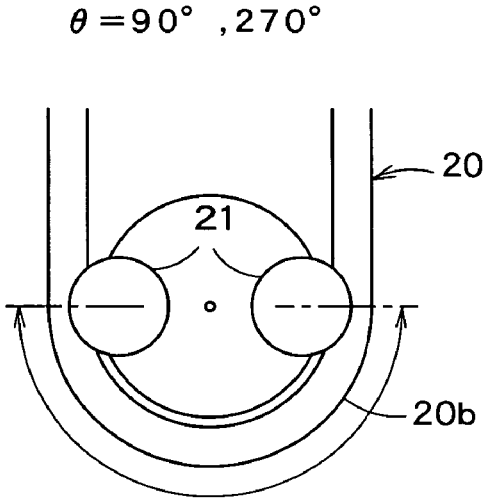
FIGS. 9A, 9B and 9C are drawings for explaining the characteristics of the tube pump shown in FIGS. 7A and 7B.
Figure 9B:
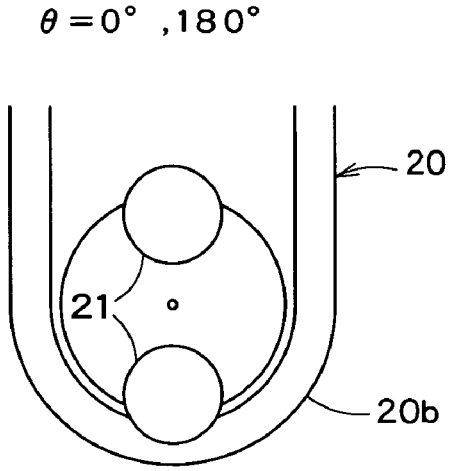
Figure 9C:
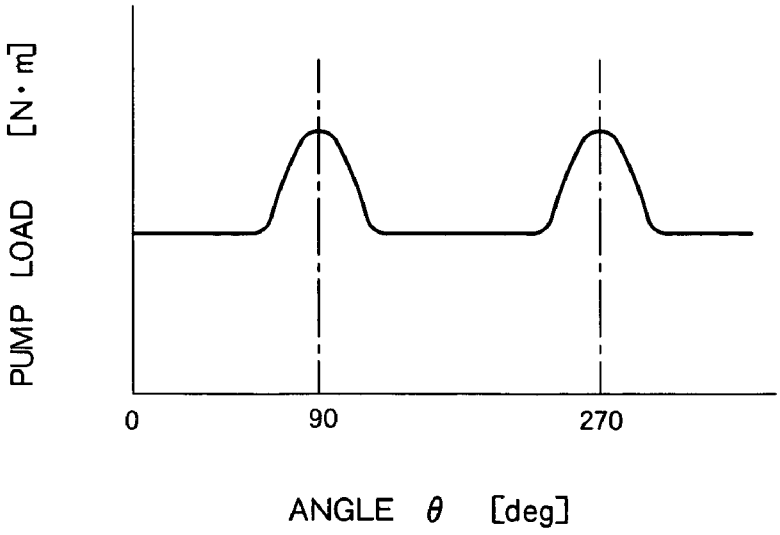

In the state that both of the pair of roller members 21 shown in FIG. 9A are pressed by the U-shaped part 20*b* of the tube member 20, compared with the state that only one roller member 21 shown in FIG. 9B is pressed by the U-shaped part 20*b* of the tube member 20, as shown in FIG. 9C, the load to the motor 22 of the tube pump 10 is doubled.

Therefore, in the aforementioned suction operation sequence shown in FIG. 8, the rotational motion of the roller member 21 is controlled so that the roller member 21, during the low-speed rotation at Step 13, passes through the maximum load position shown in FIG. 9A and immediately after it, the rotational motion of the roller member 21 is switched to high-speed rotation at Step 15. By doing this, the roller member 21 passes through the maximum load position during the low-speed rotation capable of obtaining large torque of the motor 22, thus the motor 22 is prevented from step-out, and at the point of time when the roller member 21 reaches the maximum load position again, the rotational speed of the roller member 21 is sufficiently high, so that the roller member 21 surely passes through the maximum load position by the inertia force thereof, and also here, the motor 22 is prevented from step-out.

Figure 10:
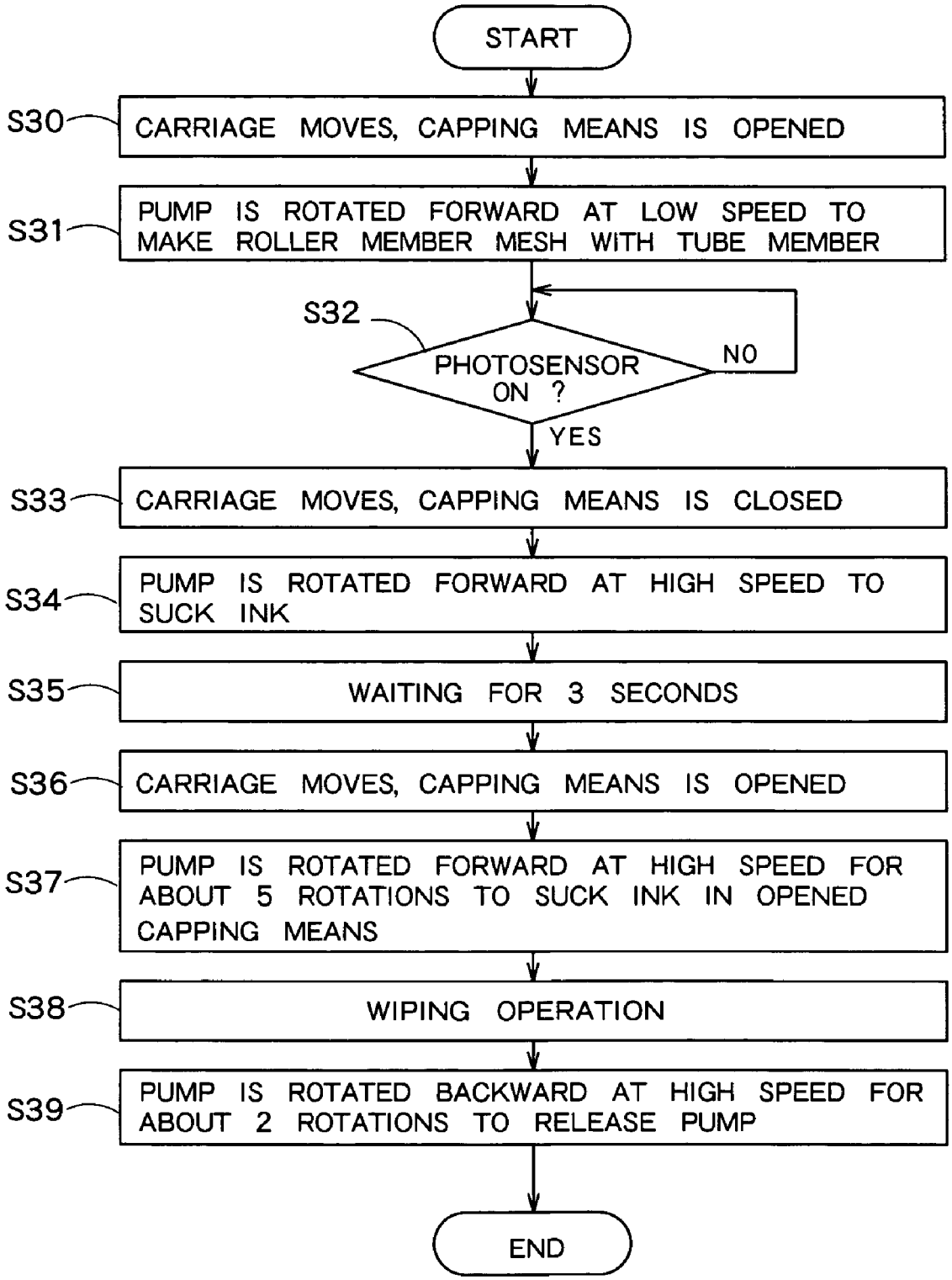
FIG. 10 is a flow chart showing still another suction operation of the ink jet recording apparatus to which the present invention is applied.

FIG. 10 shows still another control sequence of the suction operation executed by the cleaning control means 34.

Firstly, the carriage 1 is moved and the capping means 13 is put into the open state (Step 30). In this state, the roller member 21 of the tube pump 10 makes almost one rotation in the forward direction at low speed and the roller member 21 and the tube member 21 are meshed (Step 31).

The roller member 21 continues the low-speed rotation and it is decided whether the detection signal of the photosensor 28 is turned on or not (Step 32). At this time, the rotational speed of the roller member 21 is low on a level of generating no negative pressure high enough for ink suction.

When the detection signal of the photosensor 28 is turned on, the roller member 21 continues the low-speed rotation, and the carriage 1 is moved, and the nozzle forming face of the recording head 12 is closed tightly by the capping means 13 (Step 33).

Next, the rotational speed of the roller member 21 is switched to high-speed rotation for generating a negative pressure high enough for ink suction (step 34). And, at the ink suction step, the roller member 21 is rotated by a predetermined number of times according to the magnitude of a necessary suction amount.

When the ink suction step is finished, after waiting for about 3 seconds until the negative pressure is released (Step 35), the carriage 1 is moved and the capping means 13 is put into the open state (Step 36). In this state, the roller member 21 makes about five forward rotations at high speed and ink in the capping means 13 is sucked and discharged (Step 37).

Next, by the wiping means 11, the nozzle forming face of the recording head 12 is wiped out (Step 38).

Finally, the roller member 21 makes about 2 backward rotations at high speed and the pressure state of the roller member 21 to the tube member 20 is released (Step 39).

According to the aforementioned suction operation sequence shown in FIG. 10, from the positioning operation of the roller member 21 by low-speed rotation, the suction operation is continuously performed by high-speed rotation, so that the necessary time of the suction operation sequence can be shortened and step-out due to load variations of the motor 22 of the tube pump 10A can be prevented.

Figure 11:
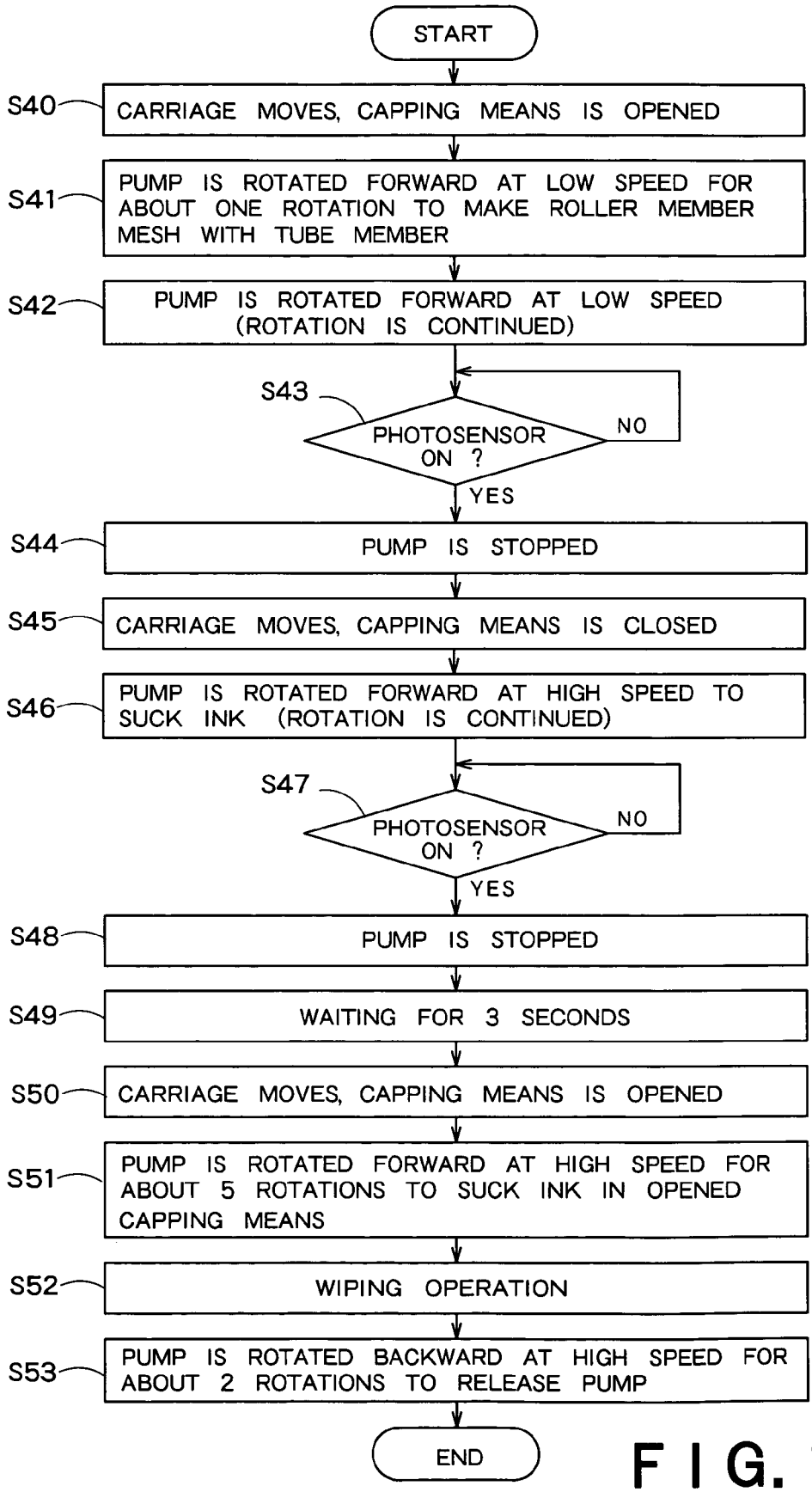
FIG. 11 is a flow chart showing a further suction operation of the ink jet recording apparatus to which the present invention is applied.

FIG. 11 shows a further another control sequence of the suction operation executed by the cleaning control means 34.

Firstly, the carriage 1 is moved and the capping means 13 is put into the open state (Step 40). In this state, the roller member 21 of the tube pump 10 makes almost one rotation in the forward direction at low speed and the roller member 21 and the tube member 21 are meshed (Step 41).

The roller member 21 continues the low-speed rotation (Step 42) and it is decided whether the detection signal of the photosensor 28 is turned on or not (Step 43). When the detection signal of the photosensor 28 is turned on, the roller member 21 stops the rotation (Step 44).

Next, the carriage 1 is moved and the nozzle forming face of the recording head 12 is closed up tightly by the capping means 13 (Step 45). And, the roller member 21 is rotated by the high-speed rotation for generating a negative pressure high enough for ink suction (Step 46). At the ink suction step, the roller member 21 is rotated by a predetermined number of times according to the magnitude of a necessary suction amount.

When the roller member 21 is rotated by the predetermined number of times at the ink suction step, it is decided whether the detection signal of the photosensor 28 is turned on or not (Step 47). When the detection signal of the photosensor 28 is turned on, the rotational motion of the roller member 21 is stopped (Step 48). The stop position of the roller member 21 at this time is a particular point other than the release point.

Then, after waiting for about 3 seconds until the negative pressure is released (Step 49), the carriage 1 is moved and the capping means 13 is put into the open state (Step 50). In this state, the roller member 21 makes about five forward rotations at high speed and ink in the capping means 13 is sucked and discharged (Step 51).

Next, by the wiping means 11, the nozzle forming face of the recording head 12 is wiped out (Step 51).

Finally, the roller member 21 makes about 2 backward rotations at high speed and the pressure state of the roller member 21 to the tube member 20 is released (Step 53).

According to the aforementioned suction operation sequence shown in FIG. 11, the forward rotations top position of the roller member 21 at the end time of the ink suction operation is controlled to a predetermined position, so that the number of rotations of the roller member 21 from the forward rotation stop time of the roller member 21 in the present ink suction operation sequence to the high-speed rotation start time (ink suction start time) in the next ink suction operation sequence is made fixed, thus the position of the roller member 21 at the start time of ink suction can be made fixed.

Figure 12:
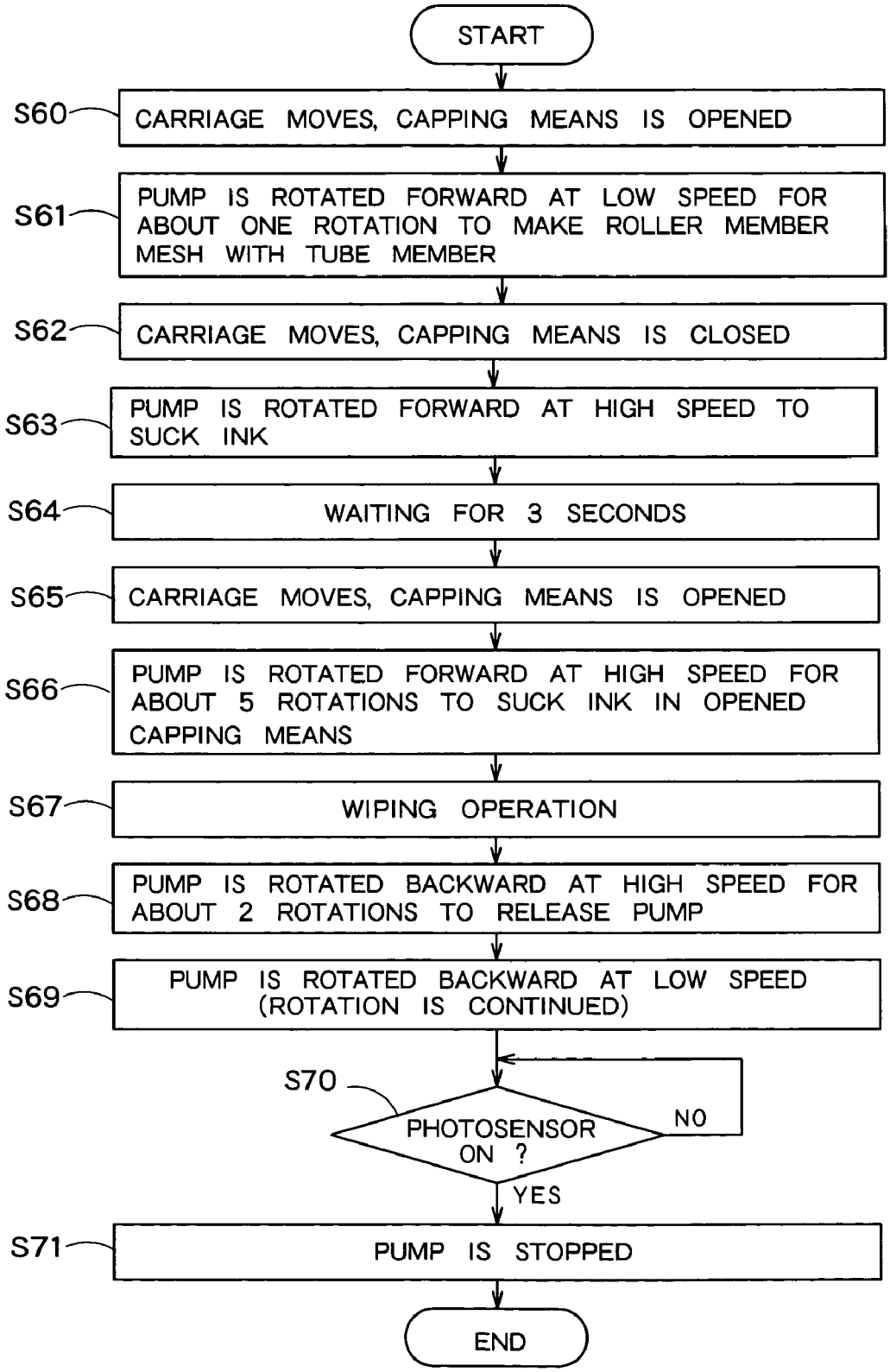
FIG. 12 is a flow chart showing a still further suction operation of the ink jet recording apparatus to which the present invention is applied.

FIG. 12 shows a still further control sequence of the suction operation executed by the cleaning control means 34.

Firstly, the carriage 1 is moved and the capping means 13 is put into the open state (Step 60). In this state, the roller member 21 of the tube pump 10 makes almost one rotation in the forward direction at low speed and the roller member 21 and the tube member 21 are meshed (Step 61).

Next, the carriage 1 is moved and the nozzle forming face of the recording head 12 is closed up tightly by the capping means 13 (Step 62). Next, the rotational speed of the roller member 21 is switched to high-speed rotation for generating a negative pressure high enough for ink suction (step 63). At the ink suction step, the roller member 21 is rotated by a predetermined number of times according to the magnitude of a necessary suction amount.

When the ink suction step is finished, after waiting for about 3 seconds until the negative pressure is released (Step 64), the carriage 1 is moved and the capping means 13 is put into the open state (Step 65). In this state, the roller member 21 makes about five forward rotations at high speed and ink in the capping means 13 is sucked and discharged (Step 66).

Next, by the wiping means 11, the nozzle forming face of the recording head 12 is wiped out (Step 67).

And, the roller member 21 makes about 2 backward rotations at high speed and the pressure state of the roller member 21 to the tube member 20 is released (Step 68).

Then, the roller member 21 switches the rotational speed to low speed and continues the low-speed rotation (Step 69), and it is decided whether the detection signal of the photosensor 28 is turned on or not (Step 70). When the detection signal of the photosensor 28 is turned on, the rotational motion of the roller member 21 is stopped (Step 71).

According to the aforementioned suction operation sequence shown in FIG. 12, the backward rotation stop position of the roller member 21 at the end time of the ink suction operation sequence is controlled to a predetermined position, so that the number of rotations of the roller member 21 from the backward rotation stop time of the roller member 21 in the present ink suction operation sequence to the high-speed rotation start time (ink suction start time) in the next ink suction operation sequence is made fixed, thus the position of the roller member 21 at the start time of ink suction can be made fixed.

Various suction operation sequences are explained above by referring to FIGS. 8, 10, 11, and 12. As shown by the explanation therefor, the position detection of the roller member 21 by the photosensor 28 is advantageous irrespective of when the position detection is executed among the cap open state, cap closed state, and transfer state from the cap open state to the cap closed state. As mentioned above, the present invention can be widely applied to various suction operation sequences.

Further, the various suction operation sequences shown in FIGS. 8, 10, 11, and 12 can be properly combined and executed and even in such a case, the respective stop positions can be set individually using a single photosensor 28 by controlling the number of rotations of the roller member 21 after phase detection.

Figure 13A:
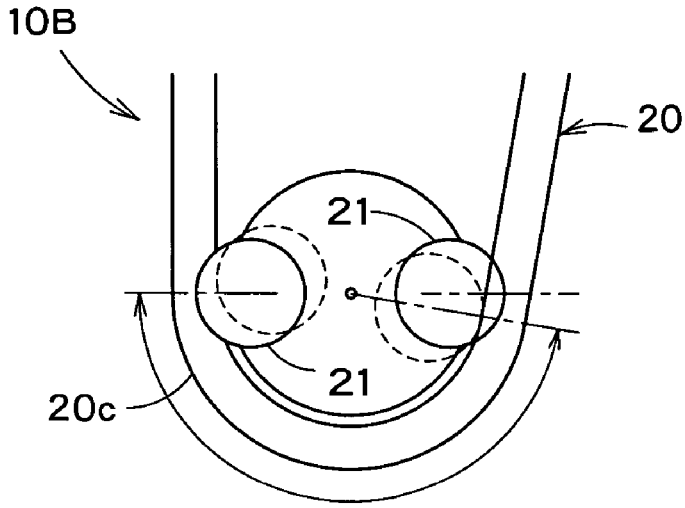
FIGS. 13A and 13B are drawings for explaining another tube pump of the ink jet recording apparatus to which the present invention is applied.

Further, the present invention can be applied to the tube pump 10B which is, as shown in FIG. 13A, of a type of pressing the pair of roller members 21 to the U-shaped tube member 20 and has a leak point. In the tube pump 10B, the section for pressing and deforming the U-shaped part 20*c* of the tube member 20 by the roller member 21 is smaller than 180°, for example, 170°. Therefore, when the roller member 21 reaches the position indicated by a dashed line in FIG. 13A, every roller member 21 does not crush the tube member 20 and the tube pump 10B enters the leak state.

Figure 13B:
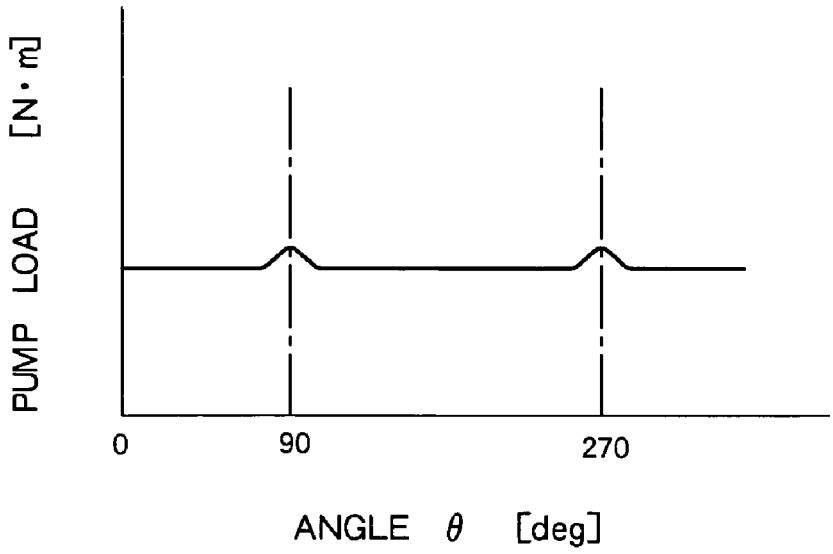

Further, the load curve of the tube pump 10B shown in FIG. 13A is as indicated in FIG. 13B. As clearly shown by comparison with the load curve shown in FIG. 9C, the tube pump 10B of a 170° pressing type shown in FIG. 13A has a maximum load smaller than that of the tube pump 10A of a 180° pressing type shown in FIGS. 7A and 7B.

And, when the various suction operation sequences aforementioned are applied to the tube pump 10B shown in FIG. 13A, not only step-out of the motor 22 can be prevented but also the suction amount can be prevented from variation. Moreover, a backflow of ink due to a pump leak at the stop time of the pump can be prevented.

Figure 14A:
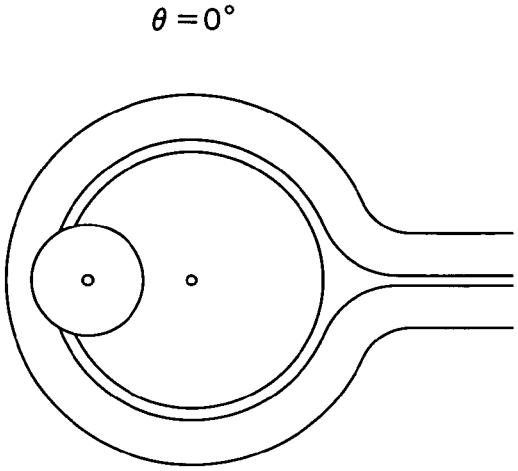
FIGS. 14A, 14B, and 14C are drawings for explaining the characteristics of the tube pump shown in FIG. 3.
Figure 14B:
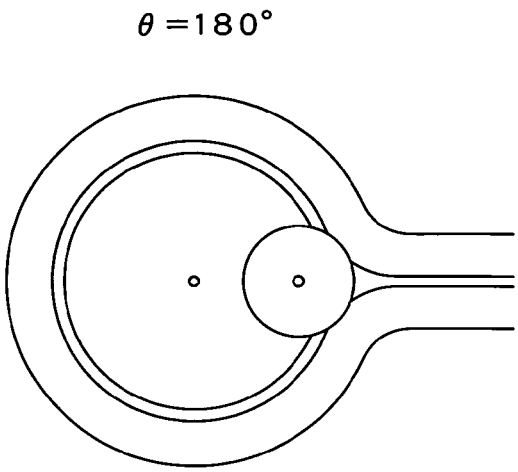
Figure 14C:
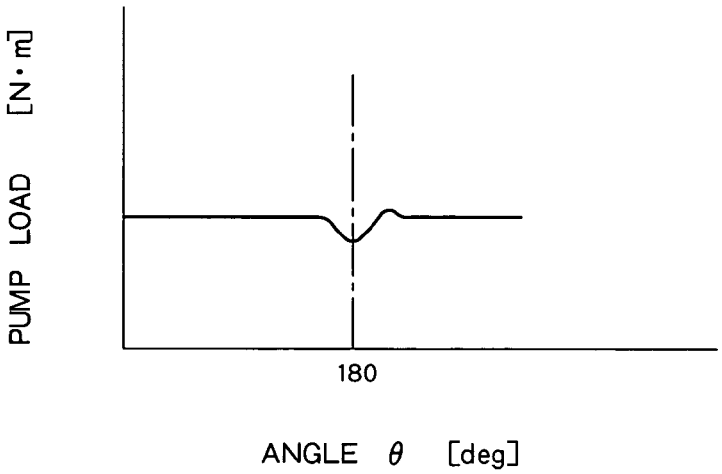

Further, even in the tube pump 10 shown in FIG. 3, as shown in FIGS. 14A, 14B, and 14C, the pump load is varied at the leak point X. However, when the various suction operation sequences aforementioned are applied, even in the tube pump 10 shown in FIG. 3, the motor 22 can be prevented from step-out.

The preferred embodiments of the present invention are described above in detail to a certain extent. However, it is clear that those can be variously changed or modified. Therefore, it will be understood that without being deviated from the range and sprit of the present invention, the present invention can be executed in embodiments other than the embodiments described specifically here.

What is claimed is:

1. A liquid ejecting apparatus, comprising:

a liquid ejecting head having nozzle openings for ejecting liquid drops;

capping means for sealing a nozzle forming face of said liquid ejecting head to form a closed space;

a tube pump for discharging a fluid in said capping means sealing said nozzle forming face, said tube pump having a flexible tube member having a curved part and a roller member rolling on an inner periphery of said curved part while pressing and deforming said tube member, wherein there exists a leak point where a pressing deformation amount of said curved part by said roller member becomes insufficient;

phase detection means for detecting a phase of a rotational motion of said roller member along said inner periphery of said curved part; and control means for controlling an operation of said tube pump, said control means having a function for stopping said roller member at a predetermined position based on an information on said phase of said rotational motion of said roller member detected by said phase detection means, wherein said predetermined position is a position other than said leak point, wherein said curved part of said tube member is in a circular ring shape, and wherein both ends of said tube member are pulled out in a same direction and bundled together in a same plane, and wherein said leak point is positioned at an area where said ends of said tube member are bundled.

2. A liquid ejecting apparatus according to claim 1, wherein said predetermined position is a position of said curved part opposite to said leak point.

3. A liquid ejecting apparatus according to claim 1, wherein said control means has a function for stopping said roller member at said predetermined position when stopping said tube pump at an end of a suction operation.

4. A liquid ejecting apparatus according to claim 1, wherein said phase detection means has a rotator rotating in synchronization with said rotational motion of said roller member and a detector for detecting a phase of a rotational motion of said rotator.

5. A liquid ejecting apparatus according to claim 4, wherein:

said rotator has a notch and said detector detects said phase of said rotational motion of said rotator based on a change in a detection signal at said notch.

6. A liquid ejecting apparatus according to claim 5, wherein said detector has a light emitter for radiating light toward said rotator and a light receiver for receiving light radiated from said light emitter.

7. A liquid ejecting apparatus, comprising:

a liquid ejecting head having nozzle openings for ejecting liquid drops;

a cap that seals a nozzle forming face of the liquid ejecting head to form a closed space;

a tube pump that discharges a fluid in the cap sealing the nozzle forming face, wherein the tube pump has a flexible tube member having a curved part and a roller member rolling on an inner periphery of the curved part while pressing and deforming the tube member, wherein a leak point exists where a pressing deformation amount of the curved part by the roller member becomes insufficient;

a phase detector that detects a phase of a rotational motion of the roller member along the inner periphery of the curved part; and a controller that controls an operation of the tube pump, wherein the controller stops the roller member at a predetermined position based on a phase of the rotational motion of the roller member detected by the phase detector, wherein the predetermined position is a position other than the leak point, wherein the curved part of the tube member has a circular ring shape, and wherein both ends of said tube member are pulled out in a same direction and bundled together in a same plane, and wherein said leak point is positioned at an area where said ends of said tube member are bundled.

* * * * *